US011145227B2

(12) United States Patent
Shardlow

(10) Patent No.: US 11,145,227 B2
(45) Date of Patent: Oct. 12, 2021

(54) SIGN HAVING A RECONFIGURABLE DISPLAY FACE

(71) Applicant: Fastrak Retail (UK) Limited, Macclesfield (GB)

(72) Inventor: Paul Shardlow, Macclesfield (GB)

(73) Assignee: Fastrak Retail (UK) Limited, Cheshire (GB)

( * ) Notice: Subject to any disclaimer, the term of this patent is extended or adjusted under 35 U.S.C. 154(b) by 0 days.

(21) Appl. No.: 16/745,793

(22) Filed: Jan. 17, 2020

(65) Prior Publication Data

US 2020/0234615 A1 Jul. 23, 2020

(30) Foreign Application Priority Data

Jan. 17, 2019 (GB) ..... 1900661

(51) Int. Cl.
*G09F 7/20* (2006.01)
*G09F 9/30* (2006.01)
*G09F 7/18* (2006.01)

(52) U.S. Cl.
CPC ..... *G09F 9/30* (2013.01); *G09F 7/20* (2013.01); *G09F 2007/1852* (2013.01)

(58) Field of Classification Search
CPC ..... G09F 9/30; G09F 7/20; G09F 2007/1852; G09F 11/23; G09F 11/02; G09F 3/202; G09F 2007/1869; G09F 3/208; G09F 19/02; G06F 1/1649; G06F 1/1622
See application file for complete search history.

(56) References Cited

U.S. PATENT DOCUMENTS 1,714,157 A 5/1929 Clark
3,553,867 A * 1/1971 Von Behren ..... G09F 11/23 40/495
4,318,238 A * 3/1982 Macarle, Jr. ..... G09F 7/00 116/63 P
5,941,493 A * 8/1999 Cheng ..... F16M 11/105 248/371
6,460,277 B1 * 10/2002 Tower ..... A44C 3/001 40/1.5

(Continued)

FOREIGN PATENT DOCUMENTS

FR 2548809 A1 1/1985
GB 339377 12/1930

(Continued)

OTHER PUBLICATIONS

Combined Search and Examination Report for GB Application No. 1900661.8, dated Jul. 5, 2019, 8 pp.

(Continued)

*Primary Examiner* — Cassandra Davis
(74) *Attorney, Agent, or Firm* — Shumaker & Sieffert, P.A.

(57) ABSTRACT

This disclosure describes a sign having a reconfigurable display face. In one example, the sign includes a sign body having a first display face and an opposed face, and a rotatable display member connected to the sign body and having a second display face. The reconfigurable display face includes the first display face and the second display face, and the display member is reconfigurable between a plurality of display orientations by rotation about a rotation axis.

20 Claims, 3 Drawing Sheets

(56) References Cited

U.S. PATENT DOCUMENTS

| | | | | |
|---|---|---|---|---|
| 7,578,084 | B2 * | 8/2009 | Wu | G09F 11/04 40/495 |
| 8,109,020 | B2 * | 2/2012 | Boyles | G09F 13/10 40/541 |
| 8,479,424 | B1 * | 7/2013 | Martin | G09F 7/22 40/531 |
| 2009/0293798 | A1 | 12/2009 | Kreshek | |
| 2011/0061276 | A1 | 3/2011 | Boyles et al. | |

FOREIGN PATENT DOCUMENTS

| | | | |
|---|---|---|---|
| JP | H08241050 | A | 9/1996 |
| WO | 2006053973 | A1 | 5/2006 |

OTHER PUBLICATIONS

Examination Report for GB Application No. 1900661.8, dated Mar. 4, 2020, 2 pp.
Examination Report for GB Application No. 1900661.8, dated Apr. 6, 2021, 2 pp.
Response to Examination Report for GB Application No. 1900661.8, filed Jul. 29, 2021, 27 pp.

* cited by examiner

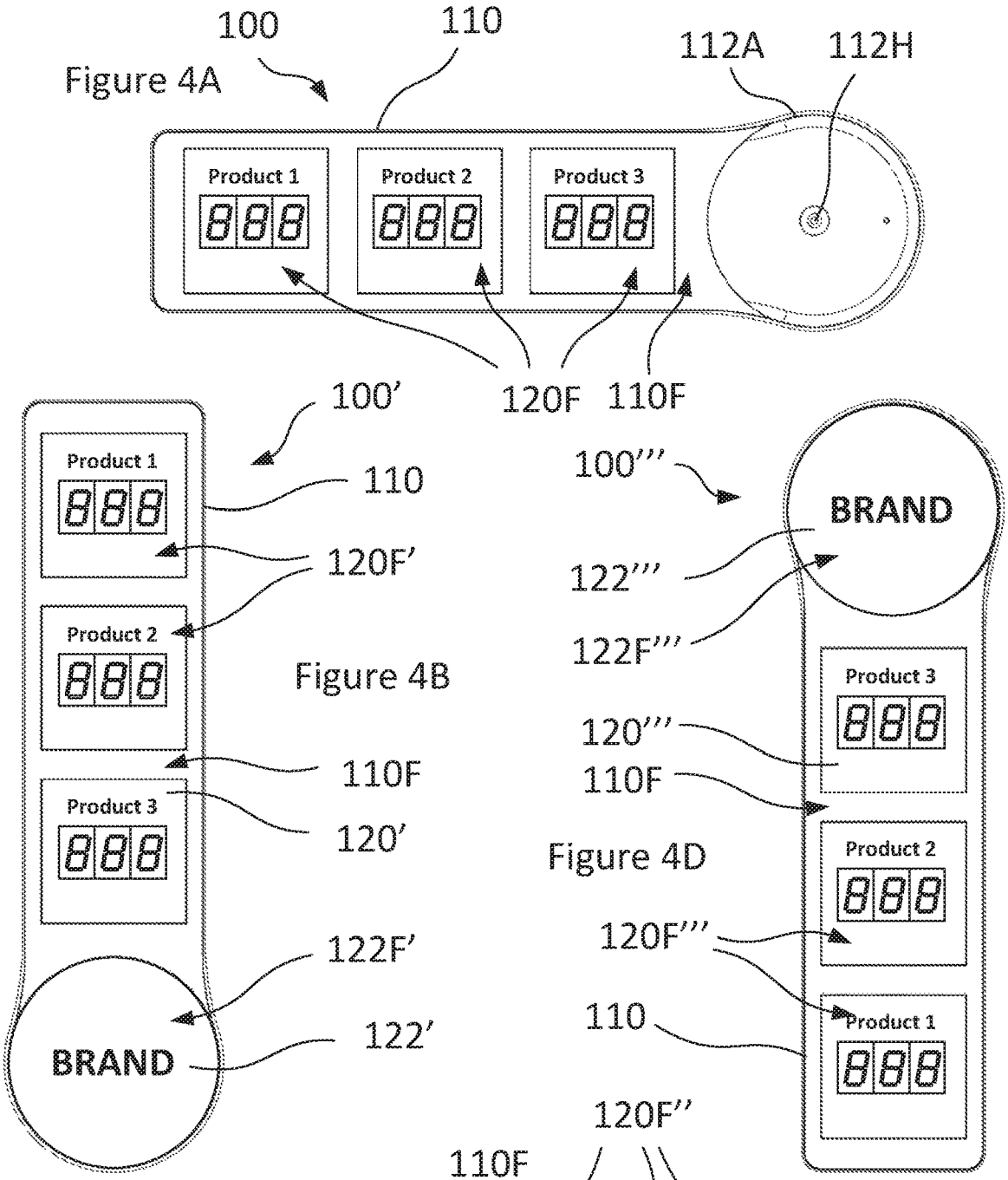
Figure 4A
Figure 4B
Figure 4D
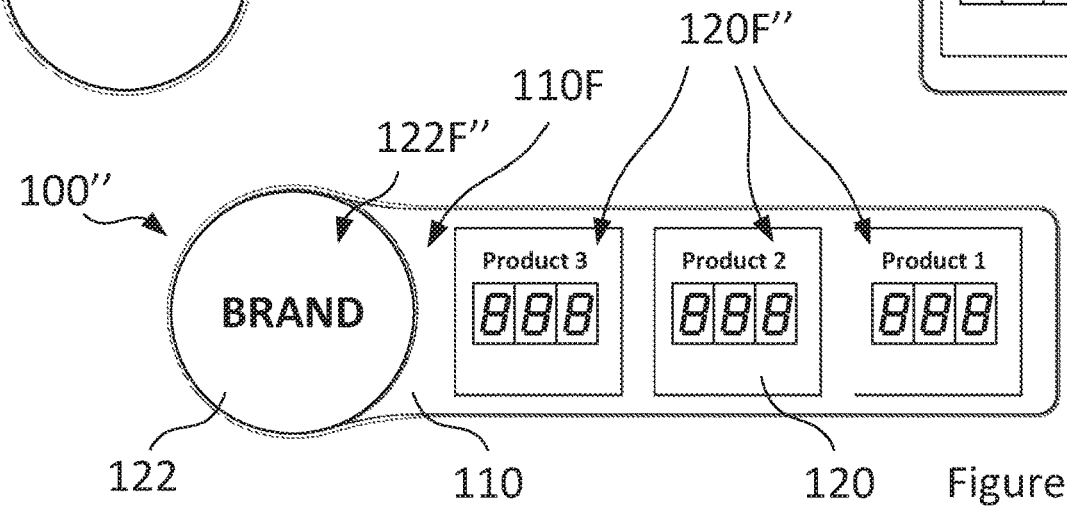
Figure 4C

SIGN HAVING A RECONFIGURABLE DISPLAY FACE

This application claims the benefit of Great Britain Application No. 1900661.8, filed 17 Jan. 2019. The entire content of Great Britain Application No. 1900661.8 is incorporated herein by reference.

TECHNICAL FIELD

The present invention relates to signs and more particularly, but not exclusively, to signs for use in the retail environment.

BACKGROUND

Signs are used in the retail environment to draw the attention of customers to retail displays. However, the space available for providing retail signage varies between retail premises, necessitating the use of signs in different orientations, necessitating correspondingly orientated signage, increasing costs.

SUMMARY OF THE DISCLOSURE

According to an aspect, there may be provided a sign having a reconfigurable display face, the sign comprising:

a sign body having a first display face and an opposed face; and a rotatable display member connected to the sign body and having a second display face, the reconfigurable display face comprising the first display face and the second display face, wherein the display member is reconfigurable between a plurality of display orientations by rotation about a rotation axis.

According to an aspect, there may be provided a sign having a reconfigurable display face, the sign comprising:

a sign body having a first display face and an opposed face; and a rotatable display member connected to the sign body and having a second display face, the reconfigurable display face comprising the first display face and the second display face, wherein the display member is reconfigurable between a plurality of display orientations by rotation about a rotation axis, the sign body may have an aperture in the first display face configured to receive the display member in each of the display orientations, and the display member has a display side and a control member extending away from the display side along the axis of rotation and accessible by a user at the opposed face for reconfiguration of the display member by the user between display orientations.

The sign body may have an aperture in the first display face configured to receive the display member in each of the display orientations.

The sign body may be provided with a recess around the aperture, and the display member is complementarily shaped for receipt within the recess in each of the display orientations.

The display member may have a body portion and a peripheral flange, wherein the body portion is complementarily shaped for receipt within the aperture when the flange abuts the sign body in each of the display orientations.

The display member may have a body portion resiliently biased towards the sign body adjacent the aperture.

The display member may have a body portion magnetically attracted to the sign body adjacent the aperture.

The display member may have a display side and a control member extending away from the display side along the axis of rotation for reconfiguration of the display member by a user between display orientations.

The sign body may have an opposed face to the first display face, and be provided with a recess into which the control member extends.

The control member may be provided with a tool engagement feature for receiving a tool for rotating the display member.

The display member may be connected to the sign body with a rotational mounting. The rotational mounting may be configured to limit the rotational range of the display member.

The display member may comprise an electrical digital display.

In each orientation the second display face may be flush with the first display face, in an at rest configuration.

BRIEF DESCRIPTION OF THE DRAWINGS

Examples are further described hereinafter with reference to the accompanying drawings, in which:

FIGS. 4A, 4B, 4C and 4D show plan views of the sign of FIG. 1A in different orientations.

DETAILED DESCRIPTION

In the described examples, like features have been identified with like numerals.

FIGS. 1A to 4D show views of a composite sign 100 having a composite, reconfigurable display face 100F. The sign 100 has a sign body 110 to which one or more rotatable display members 120 are connected.

The sign body 110 has a body face plate 110P and a back section 110B forming a housing for the rotatable display members 120, with an opposed face on the opposite side of the sign body from the face plate. The body face plate 110P has a body display face (first display face) 110F with apertures 110A for receiving the display members 120.

The composite, reconfigurable display face 100F of the composite sign 100 comprises the body display face 110F of the sign body 110 and the one or more rotatable display faces 120F of the rotatable display member 120.

The rotatable display members 120 each have a rotatable display face (second display face) 120F. The composite, reconfigurable display face 100F of the composite sign 100 comprises the body face plate 110P and the rotatable display faces 120F.

The illustrated rotatable display members 120 are each complementarily shaped for mating with a respective aperture 110A of the body face plate 110P in a plurality of at-rest rotational orientations, being orientations of the display members for ordinary use. In ordinary use, the display member 120 is maintained in the selected orientation, e.g. being biased into the mating fit (or held in place magnetically). The rotatable display members 120 can be reconfigured between different at-rest rotational orientations by rotation about a rotational axis, e.g. by rotation about a rotational axis perpendicular to the body face plate 110P. Reconfiguration is by a forward axial movement to disengage the rotatable display member 120 from the body face plate 110P, rotation about the axis, and then a reverse axial movement to re-engage the rotatable display member with the body face plate (e.g. from the rear of the sign body 110, the user depresses the swivel pin 120Y (which is a control member, and which may also be referred to as a swivel peg) against the biasing spring 120S, rotates the swivel pin, then releases the swivel pin to reengage the rotatable display member with the body face plate under the action of the spring). The rotation axis may be provided by an axle. The illustrated rotatable display members 120 and respective apertures 110A are arranged with four different at-rest rotational orientations, 90° apart (e.g. the mating fit has four-fold rotational symmetry).

The illustrated rotatable display members 120 have a body portion 120P within the housing of sign body 110, and a peripheral flange 120Q extending from the body portion 120P, outside of the sign body.

Figure 1A:
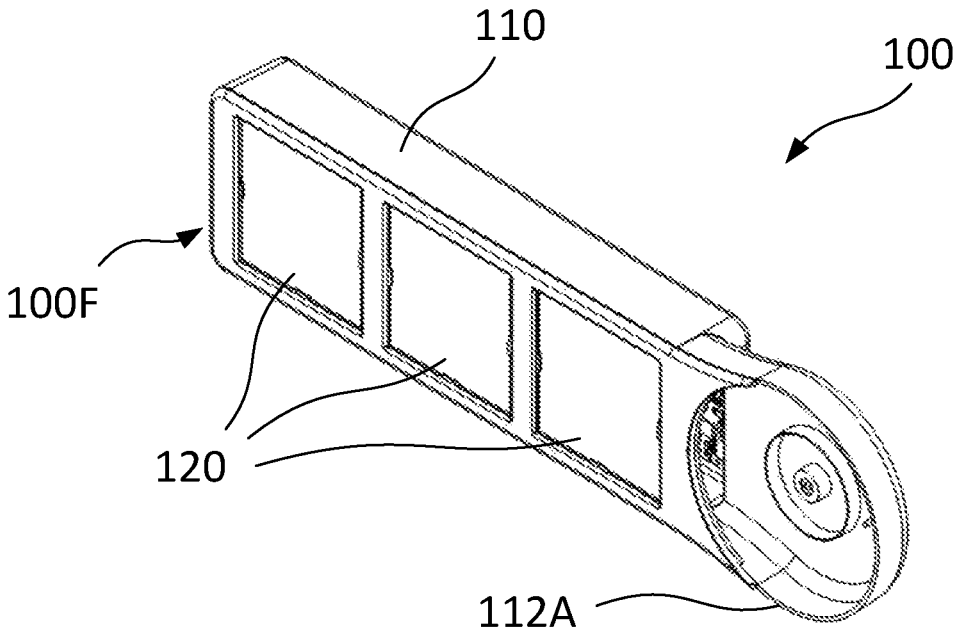
FIG. 1A shows a sign having a sign body and a plurality of reconfigurable display members.
Figure 1B:
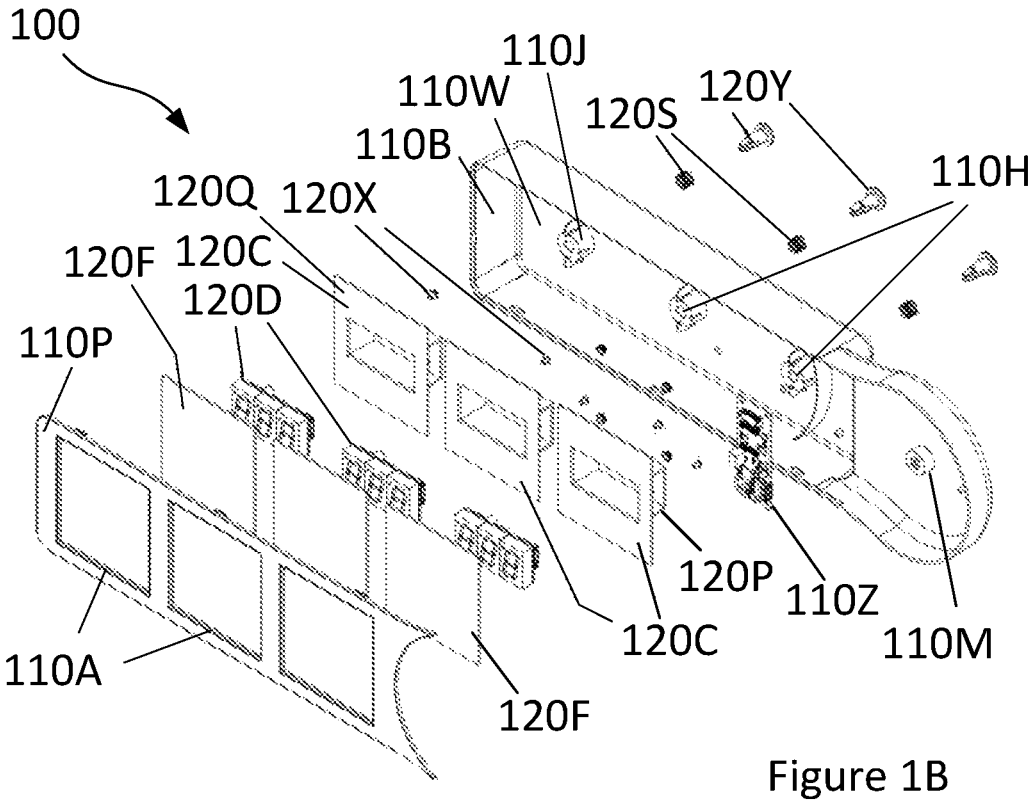
FIG. 1B shows an exploded view of the sign of FIG. 1A.
Figure 2A:
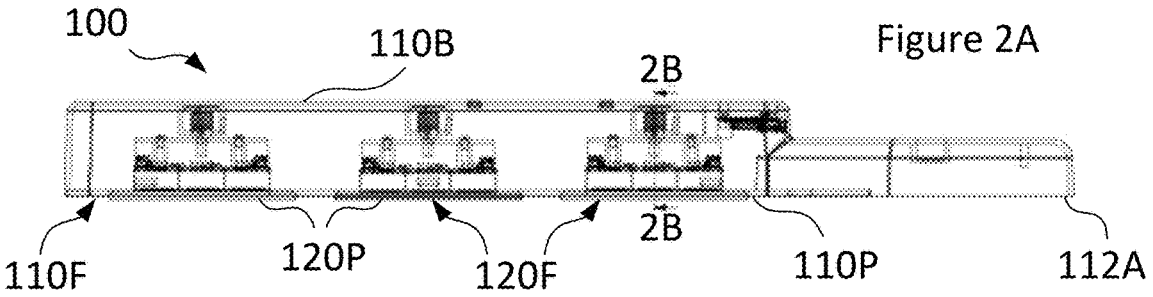
FIGS. 2A, 2B and 2C show the sign of FIG. 1A with the display member in three different orientations relative to the sign body.

FIG. 2A shows a cut-away view through the sign 100 of FIG. 1A in a configuration of ordinary use, being an at-rest configuration of the rotatable display members 120. FIG. 2B shows a perpendicular cut-away view along the line 2B-2B in FIG. 2A, and FIG. 2C shows an enlarged view of part of FIG. 2B indicated by the circle 2C.

In the illustrated sign 100, each rotatable display member 120 is rotatably mounted on the body 110 with a swivel pin 120Y (e.g. being rotatably mounted on an axle) projecting from the back of the carrier 120C, which is rotatably engaged through a respective hole 110H in the back wall (opposed back face) 110W of the back section 110B. A compressed spring 120S is mounted around each swivel pin 120Y, which engages with the head of the swivel pin, biasing the swivel pin away from the face plate 110P, and biasing the rotatable display face (second display face) 120F of the towards the face plate. The holes 110H are recessed from the back wall 110W of the back section 110B of the body 110 in control member recesses 110J. Reconfiguration of a rotatable display member 120 may be by manual manipulation of the swivel pin 120Y, e.g. by depressing the swivel ped 120Y and rotating the head of the swivel pin with a finger. Recessing the holes 110H in control member recesses 110J may shield the swivel pin 120Y from damage in use, and enhance the aesthetics of the sign 100. Alternatively or additionally, the display members 120 may be reconfigured using a tool, e.g. the swivel pins 120Y may be provided with a tool fitting for facilitating rotation of the swivel pin within the recesses 110J, e.g. being provided with a slot or other feature for receiving the head of a screw-driver or Allen key.

The rotatable mounting arrangements 120Y, 110H of the rotatable display members 120 may be configured to limit the rotational range of each display member, for example by use of a spline on the exterior of the swivel pin 120Y, and a corresponding stop within the swivel pin hole 110H. For example, the rotational range of each display member may be limited to rotation through no more than 360°. Limiting the rotational range of the display members 120 may prevent damage to electrical connections extending to the display members from within the body 110 (e.g. electrical wiring to control lighting or other controllable display of each display member).

Figure 2C:
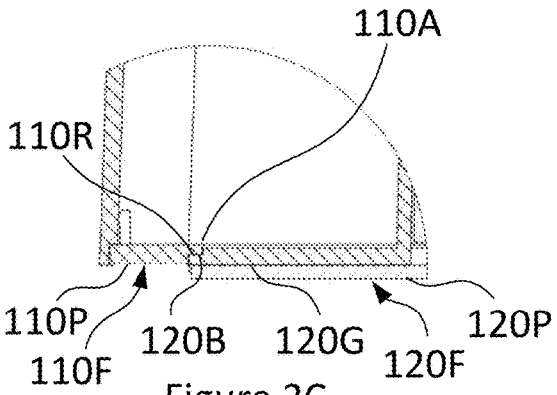
Figure 2B:
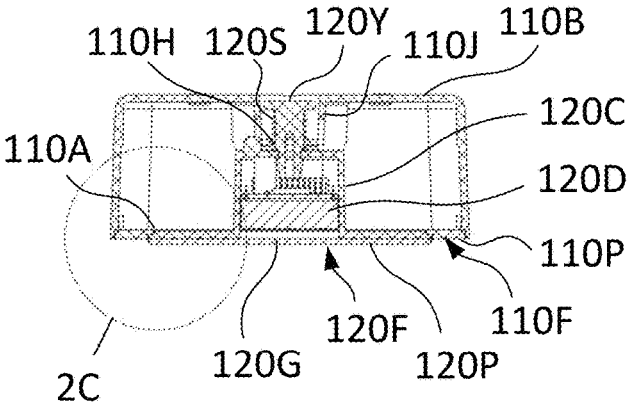

As is shown most clearly in FIG. 2C, in the at-rest position, the display portion 120G of the rotatable display member 120, having the rotatable display face 120F, is received into a corresponding aperture 110A. The exterior of the body face plate 110P is provided with a body recess 110R (e.g. for the peripheral flange 120Q) adjacent the aperture 110A (e.g. extending around the aperture), shaped to fit the display member 120. On the side of the display member 120 abutting the body face plate 110P, the display member has a display portion recess 120B adjacent its periphery (e.g. extending around the periphery), which is shaped for the display member to fit into the aperture 110A.

In the illustrated sign 100, both a body recess 110R and a display portion recess 120B are provided for alignment of the rotatable display member 120 and the body face plate 110P, in each at-rest configuration. However, alignment of the display member 120 in the at-rest rotational orientation may be provided by only one of the body recess 110R and the display portion recess 120B. Alternatively, engagement between the body portion 120P and the aperture 110A may determine the possible rotational orientations of the rotatable display member 120 at rest. In a further alternative, alignment may be provided by an alternative alignment mechanism, e.g. projecting alignment features and alignment holes for receiving those projecting alignment features, being provided on the body face plate and the display member, or by alignment features of the rotational mounting arrangement that return the rotatable display member 120 to one of discrete orientations at rest (e.g. by the mechanical engagement between the swivel pin 120Y and the hole 110H in the back wall 110W of the back section 110B).

In the illustrated sign 100, the display portion 120G (and peripheral flange 120Q) is external to the respective aperture 110A, and is biased towards the exterior surface of the body face plate 110P. However, alternatively, the display portion may be provided internally to the body and biased outwardly (forwardly), against the back of the body face plate, and into the respective aperture. Where the display portion 120G is behind the aperture 110A, one or both of a body recess on the reverse of the front plate and a display portion recess may be provided on the front of the display portion.

In the illustrated sign 100, each of the exemplary rotatable display members 120 has a digital display 120D supported on a carrier 120C connected to a front plate 110P.

Figure 3A:
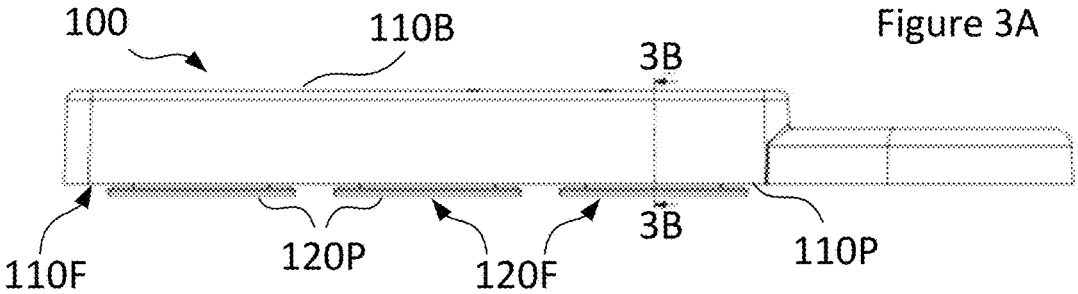
FIG. 3A shows a side view and FIGS. 3B and 3C show cut-away views of the sign of FIG. 1A during re-configuration.
Figure 3C:
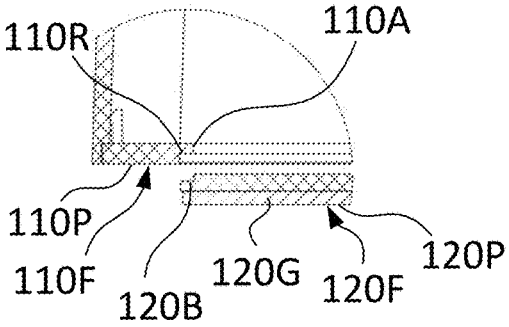
Figure 3B:
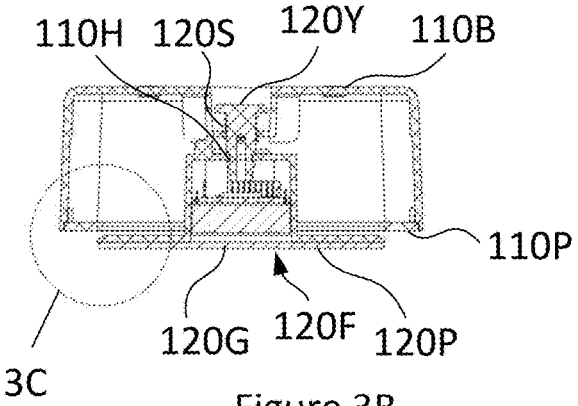

FIG. 3A shows a side view of the sign 100 of FIG. 1A during reconfiguration of the sign 100, viewed from the same position as in cut-away FIG. 2A. FIG. 3B shows a perpendicular cut-away view along the line 3B-3B in FIG. 3A, and FIG. 3C shows an enlarged view of part of FIG. 3B indicated by the circle 3C.

During reconfiguration of the illustrated sign 100, the display portion 120G is disengaged from engagement with the aperture 110A in the at-rest configuration. The display member 120 is moved against the retaining bias (e.g. bias of spring 120S), the display portion is moved outwardly from the body display face 110F (e.g. the spring is further compressed), into the position shown in FIGS. 3A to 3C. The display member 120 may then be rotated into alignment with a different at-rest rotational orientation, before being released to return to the at-rest configuration, in the selected at-rest rotational orientation, under the action of the retaining bias.

As shown in FIG. 3A, in an at-rest configuration, the rotatable display faces 120F of the rotatable display members 120 project slightly in front of the body display face 110F. Alternatively, the rotatable display faces of the display members may be flush with the body display face. In a further alternative, the rotatable display faces of the display members may be set-back behind the body display face.

In the case that the rotatable display faces of the display members are set-back behind the body display face, during reconfiguration of the sign, each display portion 120G may be moved inwardly from the body display face 110F, against a retaining bias (or against magnetic attraction to the display face 110F), to disengage from engagement with the respective aperture 110A, before being rotated into alignment with a different at-rest rotational orientation, before being released to return to the at-rest configuration, in the selected at-rest rotational orientation, under the action of the retaining bias. Arrangement of the display members for reconfiguration by inward movement to disengage from within the apertures may simplify construction of the sign, e.g. by omitting use of an externally projecting swivel pin. Alternatively, the display members may be moved back (e.g. pulled back) for rotation using the mounting arrangement, and reconfiguration is by a rearward axial movement to disengage the rotatable display member 120 from the body face plate 110P, rotation about the axis, and then a reverse axial movement to re-engage the rotatable display member with the body face plate (e.g. from the rear of the sign body 110, the user pulls the swivel pin outwardly against the biasing spring 120S, rotates the swivel pin, then releases the swivel pin to reengage the rotatable display member with the body face plate under the action of the spring).

FIGS. 4A, 4B, 4C and 4D show the composite sign 100 with the rotatable display faces 120F of the display member 120 rotated to three different orientations, with respect to the body display face 110F of the sign body 110. Accordingly, the composite sign 100 may be mounted for display in different orientations, whilst the rotatable display faces 120F of the display members 120 may be rotated into the correct display orientations for viewing by a user, e.g. a retail customer. In the illustrated sign 100, by rotation of the rotatable display faces 120F relative to the body face plate 110P, the digital displays 120D may be maintained in the correct orientation for convenient reading by a user.

The illustrated sign 100 is arranged for rotation of the rotatable display members 120 to four different at-rest rotational orientations, 90° apart. However, alternatively the composite sign may be configured for rotation of the display members to a different plurality of at-rest rotational orientations, e.g. eight rotational orientations 45° apart (e.g. the mating fit has eight-fold rotational symmetry); or two rotational orientations that are 180° apart (e.g. the mating fit has two-fold rotational symmetry). In further alternative, the sign may be configured for rotation of the display members to any rotational orientation in a continuous range (e.g. having 360° continuous rotational symmetry).

In the illustrated sign 100, a control circuit 110Z is provided for controlling operation of the digital displays 120D, and which may also control operation of lighting provided within the sign. 120X indicates fitting elements for connecting together parts of the sign 100.

The sign body 110 of the illustrated sign 100 has a further aperture 112A, for connecting a further rotatable display member 122 (shown in FIGS. 4B, 4C and 4D). The further rotatable display face 122F of the further display member 112 forms a further part of the composite rotatable display face 100F of the sign. The further display member 122 is rotatably mounted on the body 110, similarly to the rotatable display members 120, e.g. with a swivel pin 120Y projecting from the carrier 120C, is rotatably engaged through a respective hole 110H in the back wall 110W of the back section 110B. The further aperture 112A is circular, and the further rotatable display member 122 is complementarily shaped for mating with the further aperture 112A in a plurality of rotational orientations in a continuous range, e.g. having 360° continuous rotational symmetry.

In use within a retail environment, the sign 100 may be mounted to a retail display, e.g. using a mounting bracket (not shown), with the sign body 100 in the required orientation, and the rotatable display faces 120F, 122F of the display members 120, 122 may be rotated to an orientation corresponding with the orientation of the sign body, e.g. in which the display of the rotatable display faces is correctly orientated for viewing by a retail customer.

In the illustrated composite sign 100, the sign body 110 is elongate and provided with three rotatable display members 120, and a further display member 122, arranged in a linear array. However, the sign body is not limited to an elongate arrangement, e.g. the sign may have a generally circular or square composite, reconfigurable display face. Alternatively, the composite sign may have a different plurality of rotatable display members, e.g. two, three, five or more. Further, the plurality of rotatable display members may be distributed in a different arrangement, e.g. a two-dimensional array, or in an irregular arrangement. Alternatively, the composite sign may have a single rotatable display member 120.

In the illustrated sign 100, the rotatable display members 120 are biased into the at-rest configuration by a compression spring 120S. Alternatively, the display members may be retained in the at-rest configuration by a friction fit, e.g. by using a mounting that releasably clips into place. In a further alternative, the display members may be held in place magnetically, and reconfigured by drawing the display members away against a bias provided magnetically. In further alternative, the display members may be rotated electromechanically, e.g. being mounted on an axle rotatable by an electric motor. In the case of electromechanical rotation, the display members may be configured for rotation in a continuous range, with a controller controlling the orientation of the display members electromechanically. In an alternative, the display members may be mounted in a fixed rotational orientation within the sign body, which is opened (e.g. by removing the face plate) to release the display members for rotation, before the sign body is closed to maintain the display members in their new rotational orientations. In a further alternative, the display members may be held in place by the engagement of a bolt or screw, which is unscrewed to release the display members for rotation, before being retightened to maintain the display members in their new rotational orientations.

The figures provided herein are schematic and not to scale.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A sign having a reconfigurable display face, the sign comprising:

a sign body having a first display face and an opposed face; and a rotatable display member connected to the sign body and having a second display face, the reconfigurable display face comprising the first display face and the second display face, wherein the display member is reconfigurable between a plurality of display orientations by rotation about a rotation axis, wherein the display member comprises an electrical digital display, and wherein the sign body has an aperture in the first display face configured to receive the display member in each of the display orientations.

2. The sign according to claim 1, wherein the sign body is provided with a recess around the aperture, and the display member is complementarily shaped for receipt within the recess in each of the display orientations.

3. The sign according to claim 1, wherein the display member has a body portion and a peripheral flange, wherein the body portion is complementarily shaped for receipt within the aperture when the flange abuts the sign body in each of the display orientations.

4. The sign according to claim 1, wherein the display member has a body portion that is resiliently biased towards the sign body adjacent the aperture.

5. The sign according to claim 1, wherein the display member has a display side and a control member extending away from the display side along the axis of rotation and accessible at the opposed face by a user for reconfiguration of the display member by the user between display orientations.

6. The sign according to claim 5, wherein the sign body is provided with a recess into which the control member extends.

7. The sign according to claim 5, wherein the control member is provided with a tool engagement feature for receiving a tool for rotating the display member.

8. The sign according to claim 1, wherein the display member is connected to the sign body with a rotational mounting that is configured to limit the rotational range of the display member.

9. A sign having a reconfigurable display face, the sign comprising:

a sign body having a first display face and an opposed face; and a rotatable display member connected to the sign body and having a second display face, the reconfigurable display face comprising the first display face and the second display face, wherein the display member is reconfigurable between a plurality of display rotational orientations, wherein the sign body has an aperture in the first display face configured to receive the display member in each of the display orientations, and wherein the display member is reconfigurable between the plurality of display rotational orientations by axial movement to disengage the display member from within the aperture, rotation about a rotation axis, and a reverse axial movement to re-engage the display member within the aperture.

10. The sign according to claim 9, wherein the sign body is provided with a recess around the aperture, and the display member is complementarily shaped for receipt within the recess in each of the display orientations.

11. The sign according to claim 9, wherein the display member has a body portion and a peripheral flange, wherein the body portion is complementarily shaped for receipt within the aperture when the flange abuts the sign body in each of the display orientations.

12. The sign according to claim 9, wherein the display member has a body portion that is resiliently biased towards the sign body adjacent the aperture.

13. The sign according to claim 9, wherein the display member has a body portion that is magnetically attracted to the sign body adjacent the aperture.

14. The sign according to claim 9, wherein the display member is connected to the sign body with a rotational mounting that is configured to limit the rotational range of the display member.

15. The sign according to claim 9, wherein the display member comprises an electrical digital display.

16. The sign according to claim 9, wherein in each orientation the second display face is flush with the first display face, in an at rest configuration.

17. The sign according to claim 9, wherein the display member has a display side and a control member extending away from the display side along the rotation axis and accessible at the opposed face by a user for reconfiguration of the display member by the user between display orientations.

18. The sign according to claim 17, wherein the sign body is provided with a recess into which the control member extends.

19. The sign according to claim 17, wherein the control member is provided with a tool engagement feature for receiving a tool for rotating the display member.

20. A sign having a reconfigurable display face, the sign comprising:

a sign body having a first display face and an opposed face; and a rotatable display member connected to the sign body and having a second display face, the reconfigurable display face comprising the first display face and the second display face, wherein the display member is reconfigurable between a plurality of display orientations by rotation about a rotation axis, wherein the sign body has an aperture in the first display face configured to receive the display member in each of the display orientations, and wherein in each orientation the second display face is flush with the first display face, in an at rest configuration.

* * * * *